US008674592B2

(12) United States Patent
Nakamura et al.

(10) Patent No.: US 8,674,592 B2
(45) Date of Patent: Mar. 18, 2014

(54) SPARK PLUG HAVING A CRIMP PORTION IN THE METAL SHELL TO FIRMLY ENGAGE WITH THE CERAMIC INSULATOR

(75) Inventors: Mai Nakamura, Inazawa (JP); Jiro Kyuno, Kiyosu (JP); Tomoaki Kato, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/821,150

(22) PCT Filed: Aug. 18, 2011

(86) PCT No.: PCT/JP2011/004617

§ 371 (c)(1), (2), (4) Date: Mar. 6, 2013

(87) PCT Pub. No.: WO2012/056618

PCT Pub. Date: May 3, 2012

(65) Prior Publication Data

US 2013/0162135 A1 Jun. 27, 2013

(30) Foreign Application Priority Data

Oct. 29, 2010 (JP) ..... 2010-243037

(51) Int. Cl.
*H01T 13/20* (2006.01)

(52) U.S. Cl.
USPC ..... 313/143; 313/141; 313/142; 123/169 R

(58) Field of Classification Search
USPC ..... 313/118–143; 123/169 R, 169 EL, 32, 123/41, 310
See application file for complete search history.

(56) References Cited

U.S. PATENT DOCUMENTS

2003/0168955 A1 9/2003 Suzuki
2007/0046162 A1 3/2007 Moribe et al.

FOREIGN PATENT DOCUMENTS

JP 2003-257583 A 9/2003
JP 2007-258142 A 10/2007

*Primary Examiner* — Tracie Y Green
(74) *Attorney, Agent, or Firm* — Leason Ellis LLP.

(57) ABSTRACT

A spark plug includes a ceramic insulator having a tapered rear end stepped portion whose diameter decreases from front to rear and a metal shell having a crimp portion which crimps the rear end stepped portion from the rear end. An area defined by an outer edge of the rear end stepped portion and an inner edge of the crimp portion is 5-25 $mm^2$ when the spark plug is projected on a plane perpendicular to an axial line. An angle formed by a tapered surface of the rear end stepped portion and a plane perpendicular to the axial line is 20-60 degrees. A distance along the axial line from a front end of a proximal portion of the crimp portion to a frontmost position of a contact portion between an inner surface of the crimp and the rear end stepped portion is 0.4-1.8 mm.

11 Claims, 7 Drawing Sheets

Fig. 1

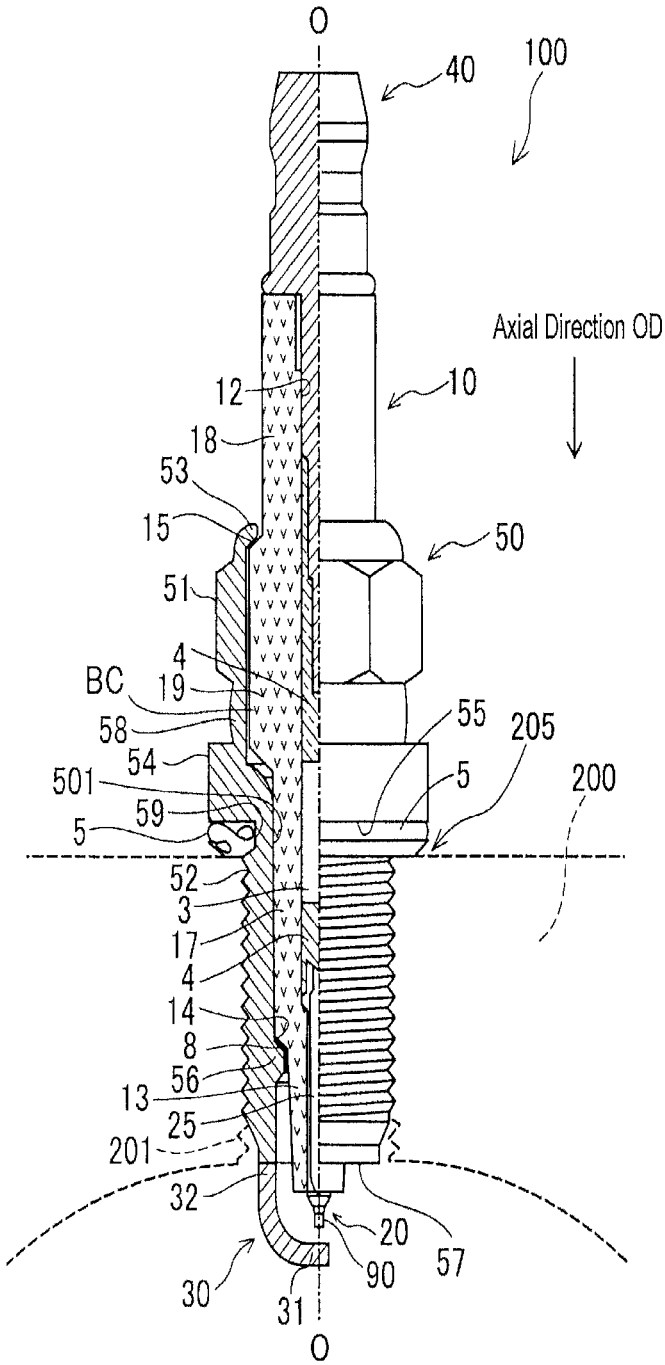

3··· Ceramic Resistor
4··· Seal Member
5··· Gasket
8··· Sheet Packing
10··· Ceramic Insulator
12··· Axial Bore
13··· Insulator Nose
14··· Front End Side Stepped Portion
15··· Rear End Side Stepped Portion
17··· Front End Side Trunk Portion
18··· Rear End Side Trunk Portion
19···Flange
20···Center Electrode
25···Core
30···Grond Electrode
31··· Base Member Front End Portion
32···Proximal End
40···Metal Terminal
50···Metal Shell
51···Tool Engagement Portion
52···Mounting Threaded Portion
53···Crimp Portion
54···Seal Portion
55···Seat Surface
56···Stepped Portion
57···Front End Surface
58···Contractive Deformation Portion
59···Screw Neck
90···Electrode Tip
100···Spark Plug
200···Engine Head
201··· Mounting Threaded Hole
205··· Peripheral Surface around the Opening
501···Insertion Hole Fig. 5
(A)
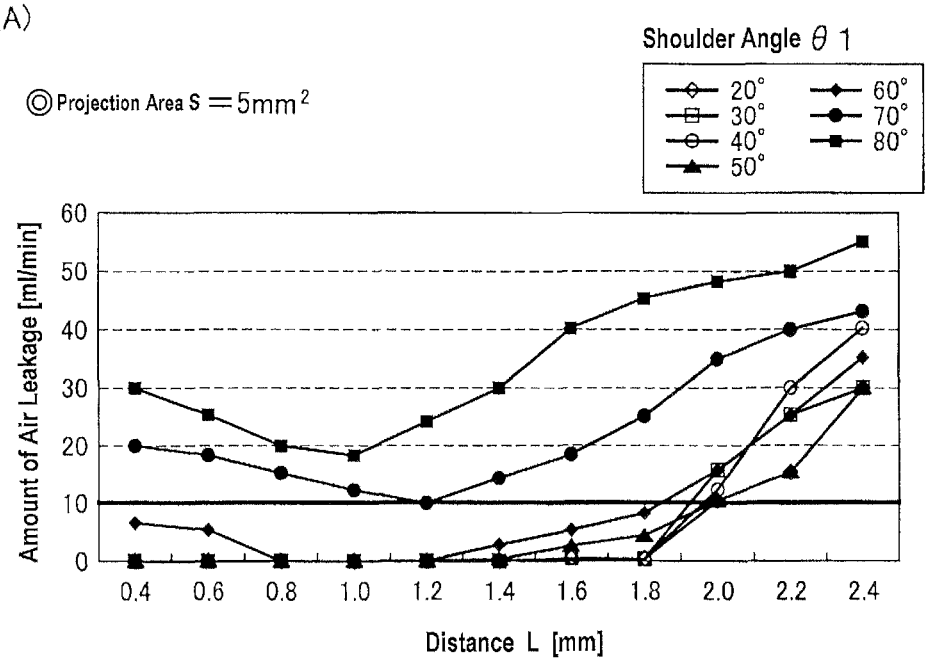
(B)
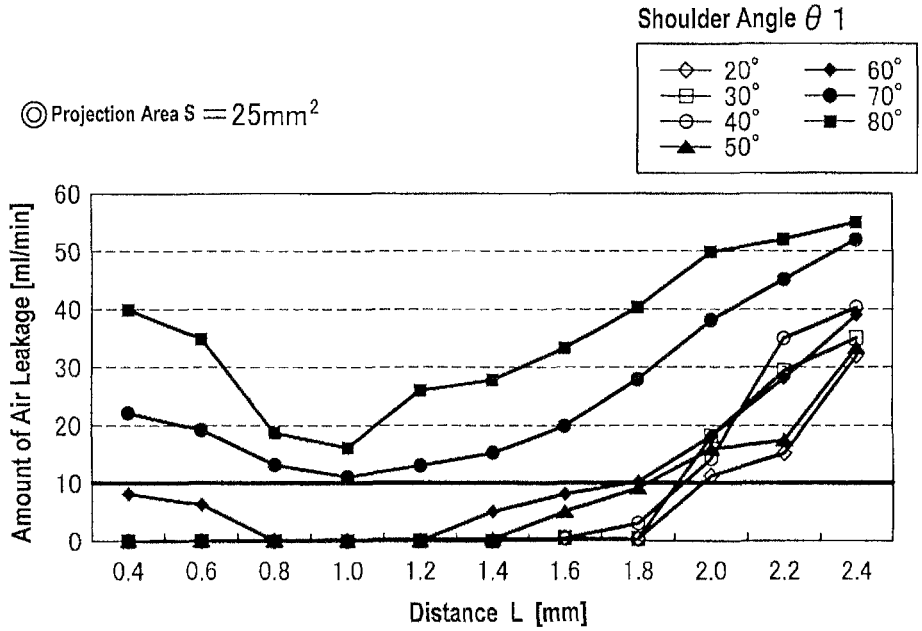

SPARK PLUG HAVING A CRIMP PORTION IN THE METAL SHELL TO FIRMLY ENGAGE WITH THE CERAMIC INSULATOR

CROSS-REFERENCE TO RELATED PATENT APPLICATIONS

This application is a U.S. National Phase Application under 35 U.S.C. §371 of International Patent Application No. PCT/JP2011/004617, filed Aug. 18, 2011, and claims the benefit of Japanese Patent Application No. 2010-243037, filed Oct. 29, 2010, all of which are incorporated by reference herein. The International Application was published in Japanese on May 3, 2012 as International Publication No. WO/2012/056618 under PCT Article 21(2).

FIELD OF THE INVENTION

The present invention relates to a spark plug, particularly to a technique for fitting a metal shell to a ceramic insulator.

BACKGROUND OF THE INVENTION

Recently, there has been a demand for reduction in size (diameter) of a spark plug in order to attain a higher degree of engine design flexibility for improvement in engine performance, such as engine output and efficiency. For example, the diameter reduction of the spark plug leads to the formation of a smaller plug hole and permits the arrangement of a larger water jacket and intake/exhaust ports in the engine.

It is, however, undesirable to simply reduce the diameter of the spark plug because a crimp portion formed in an end portion of a metal shell for fitting the insulator to the metal shell is made small. As a result, a problem, such as air leakage and the ceramic insulator falling out from the metal shell, tends to occur (refer to Japanese Patent Application Laid-Open (kokai) No. 2007-258142).

SUMMARY OF THE INVENTION

Problem(s) to be Solved by the Invention

The present invention has been conceived to solve the above-mentioned conventional problem, and an object of the invention is to provide a technique for firmly holding a ceramic insulator by a crimp portion of a metal shell even though a diameter of a spark plug is reduced in size.

Means for Solving the Problem

In order to solve, at least partially, the above problem, the present invention can be embodied in the following modes or application examples.

[Aspect 1]

A spark plug comprising:

a generally cylindrical ceramic insulator including an axial bore extending along an axial line, a front end stepped portion whose diameter tapering from a rear end side to a front end side and a tapered rear end stepped portion positioned rearward of the front end stepped portion and whose diameter tapering from the front end side to the rear end side, both the front end stepped portion and the rear end stepped portion formed on an outer circumferential surface of the ceramic insulator;

a generally cylindrical metal shell including an engaging stepped portion that is formed on an inner circumferential surface thereof and engaged with the front end stepped portion of the ceramic insulator from the rear end side and a crimp portion that is formed in a rear end portion of the metal shell and crimps the rear end stepped portion of the ceramic insulator from the rear end side, the metal shell fitted to the outer circumferential surface of the ceramic insulator, wherein an area S defined by an outer edge of the rear end stepped portion and an inner edge of the crimp portion falls within a range of 5 $mm^2$ to 25 $mm^2$ when the spark plug is projected on a plane perpendicular to the axial line, an angle θ1 formed by a tapered surface of the rear end stepped portion and a plane perpendicular to the axial line falls within a range of 20 degrees to 60 degrees, and a distance L along the axial line from a front end of a proximal portion of the crimp portion to a frontmost position of a contact portion between an inner surface of the crimp portion and the rear end stepped portion falls within a range of 0.4 mm to 1.8 mm.

[Aspect 2]

The spark plug according to Aspect 1, wherein the angle θ1 falls within a range of 20 degrees to 50 degrees, and the distance L falls within a range of 0.8 mm to 1.4 mm.

[Aspect 3]

The spark plug according to Aspect 1 or 2, wherein, when the tapered surface of the rear end stepped portion is extended in an outer circumferential direction, an angle θ2 defined by the tapered surface and an outer surface of the crimp portion falls within a range of 15 degrees to 50 degrees.

[Aspect 4]

The spark plug according to any one of Aspects 1 to 3, wherein a diameter D of an outermost circumferential portion of the rear end stepped portion falls within a range of 7 mm to 10 mm.

[Aspect 5]

The spark plug according to any one of Aspects 1 to 4, wherein the rear end stepped portion and the inner surface of the crimp portion are in contact with each other through a packing.

The present invention can be implemented not only in the above-described spark plug, but also in a method for manufacturing a spark plug and an internal combustion engine provided with a spark plug.

Effect of the Invention

The spark plug of Aspect 1 having the area S falling within the range of 5 $mm^2$ to 25 $mm^2$, the angle θ1 falling within the range of 20 degrees to 60 degrees and the distance L falling within the range of 0.4 mm to 1.8 mm is capable of firmly holding the ceramic insulator by the crimp portion that is formed in the rear end portion of the metal shell, even though the spark plug diameter is reduced in size.

According to the spark plug of Aspect 2, the ceramic insulator is further firmly held by the crimp portion formed in the rear end portion of the metal shell.

According to the spark plug of Aspect 3, it is possible to improve loosening-proof properties of the crimp portion.

According to the spark plug of Aspect 4, the ceramic insulator may be firmly held by the crimp portion of the metal shell, even though the spark plug has a relatively small diameter such that the diameter of the outermost circumferential portion of the rear end stepped portion falls within a range of 7 mm to 10 mm.

According to the spark plug of Aspect 5, since the friction between the rear end stepped portion of the ceramic insulator and the inner surface of the crimp portion develops, the ceramic insulator is further firmly held by the crimp portion of the metal shell.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 1 is a partially sectioned view of a spark plug according to an embodiment of the present invention.

FIG. 5 is a graph showing a relationship between a distance L, a shoulder angle θ1 and an amount of air leakage.

DETAILED DESCRIPTION OF THE INVENTION

[Mode for Carrying Out the Invention]

A. Embodiment

Figure 2:
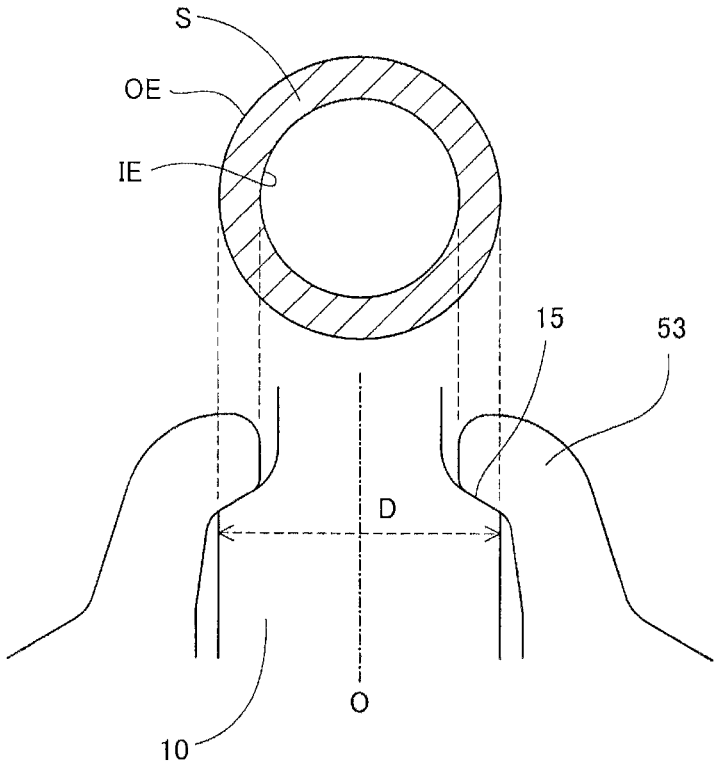
FIG. 2 is an enlarged view of a contact portion between an inner surface of a crimp portion and a rear end stepped portion of a ceramic insulator.

FIG. 1 is a partially sectioned view of a spark plug 100 according to an embodiment of the present invention. In the following description, an axial direction OD of the spark plug 100 in FIG. 1 is referred to as the vertical direction, the lower side of the spark plug 100 in FIG. 1 is referred to as the front end side of the spark plug 100, and the upper side as the rear end side. In FIG. 1, the right-hand side of the axial line O-O indicated with a dashed line shows an elevation view, and the left-hand side of the axial line O-O shows a sectional view where the spark plug 100 is sectioned by a plane that passes the center axis of the spark plug 100.

The spark plug 100 includes a ceramic insulator 10 serving as an insulator, a metal shell 50, a center electrode 20, a ground electrode 30, and a metal terminal 40. An insertion hole 501 extending in the axial direction. OD is formed in the metal shell 50. The ceramic insulator 10 is inserted and held in this insertion hole 501. The center electrode 20 is held in an axial bore 12 formed in the ceramic insulator 10 in the axial direction OD. A front end portion of the center electrode 20 is exposed at the front end side of the ceramic insulator 10. The ground electrode 30 is joined to a front end portion (downward end in FIG. 1) of the metal shell 50. The metal terminal 40 is provided in a rear end portion (upward end in FIG. 1) of the center electrode 20, and the rear end portion of the metal terminal 40 is exposed to the rear end side of the ceramic insulator 10.

As it is widely known, the ceramic insulator 10 is formed from alumina, etc. through firing and has a cylindrical tubular shape, and its axial bore 12 extends coaxially along the axial direction OD. The ceramic insulator 10 has a flange portion 19 having the largest outer diameter and located approximately at the center with respect to the axial direction OD and a rear trunk portion 18 located rearward (upward in FIG. 1) of the flange portion 19. A tapered rear end stepped portion 15 tapered towards the rear end side from the front end side is formed between the flange 19 and the rear trunk portion 18. The ceramic insulator 10 also has a front trunk portion 17 smaller in outer diameter than that of the rear trunk portion 18 and located frontward (downward in FIG. 1) of the flange portion 19, and an insulator nose 13 smaller in outer diameter than that of the front trunk portion 17 and located frontward of the front trunk portion 17. The insulator nose 13 is reduced in diameter in the frontward direction and is exposed to a combustion chamber of an internal combustion engine when the spark plug 100 is mounted on an engine head 200 of the engine. Between the insulator nose 13 and the front trunk portion 17, a front end stepped portion 14 tapered towards front end side from the rear end side is formed on an outer circumferential surface of the insulator.

The metal shell 50 is a cylindrical metallic member and is adapted to fix the spark plug 100 to the engine head 200 of the internal combustion engine. The metal shell 50 holds the ceramic insulator 10 therein while surrounding the ceramic insulator 10 in a region extending from a portion of the rear trunk portion 18 to the insulator nose 13. That is, the ceramic insulator 10 is inserted in the insertion hole 501 of the metal shell 50 so that the front end and the rear end of the ceramic insulator 10 are exposed from the front end and the rear end of the metal shell 50, respectively. The metal shell 50 is formed from low-carbon steel, and nickel plating is applied to the entire metal shell 50. The metal shell 50 has a hexagonal tool engagement portion 51 and a mounting threaded portion 52. The tool engagement portion 51 allows a spark wrench (not shown) to be fitted thereto. The mounting threaded portion 52 of the metal shell 50 has a thread formed thereon, and is screwed into amounting threaded hole 201 of the engine head 200 provided at an upper portion of the internal combustion engine. In addition, although the nickel plating is employed to the entire metal shell 50 in this embodiment, zinc plating may be also employed thereto.

The metal shell 50 has a flange-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a peripheral surface 205 around the opening of the mounting threaded hole 201. The deformation of the gasket 5 provides a seal between the spark plug 100 and the engine head 200, thereby preventing air leakage from the interior of the engine via the mounting threaded hole 201.

The metal shell 50 has a thin-walled crimp portion 53 located rearward of the tool engagement portion 51. The metal shell 50 also has a contractive deformation portion 58, which is thin-walled similar to the crimp portion 53, between the seal portion 54 and the tool engagement portion 51. The crimp portion 53 is bent inward so that the inner surface of the crimp portion 53 is brought into contact with the rear end stepped portion 15 of the ceramic insulator 10 during the crimping operation. The ceramic insulator 10 is pressed forward within the metal shell 50 due to the deformation of the contractive deformation portion 58 to which a compression force is applied. As a result of the pressing, the front end stepped portion 14 of the ceramic insulator 10 is compressed towards the step portion 56 formed on the inner circumference of the metal shell 50 through the sheet packing 8, whereby the ceramic insulator 10 is held by and accommodated in the metal shell 50.

The center electrode 20 is a rod-like electrode having a structure in which a core 25 is embedded within an electrode base member 21. The electrode base member 21 is formed of nickel or an alloy, such as INCONEL (trademark) 600, which contains Ni as a predominant component. The core 25 is formed of copper or an alloy which contains Cu as a predominant component, copper and the alloy being superior in thermal conductivity to the electrode base member 21. Normally, the center electrode 20 is fabricated as follows: the core 25 is placed within the electrode base member 21 which is formed into a closed-bottomed tubular shape, and the resultant assembly is drawn by extrusion from the bottom side. The core 25 is formed such that, while its trunk portion has a substantially constant outer diameter, its front end portion is tapered. A front end portion of the center electrode 20 assumes a tapered shape that tapers towards the front end. An electrode tip 90 is joined to a front end of the tapered shape portion. The electrode tip 90 is formed of noble metal as a predominant component with a high-melting point so as to improve spark erosion resistance. The electrode tip 90 contains, for example, iridium (Ir) and an Ir alloy containing Ir as a predominant component.

The center electrode 20 disposed in the axial bore 12 of the ceramic insulator 10 extends toward the rear end side, and is electrically connected to the metal terminal 40 via a seal member 4 and a ceramic resistor 3. A high-voltage cable (not shown) is connected to the metal terminal 40 via a plug cap (not shown) so as to apply high voltage to the metal terminal 40.

A base material of the ground electrode 30 is formed of a metal having high corrosion resistance; for example, a Ni alloy. In this embodiment, a Ni alloy called INCONEL (trademark) 600 (INC600) is employed. A proximal end portion 32 of the ground electrode 30 is joined to a front end surface of the metal shell 50 through welding. The ground electrode 30 is bent such that a surface of a distal end portion 31 of the ground electrode 30 faces, on the axial line O, the electrode tip 90 of the center electrode 20 in the axial direction OD. A spark gap is formed between the surface of the distal end portion 31 of the ground electrode 30 and a front end surface of the electrode tip 90.

Figure 3:
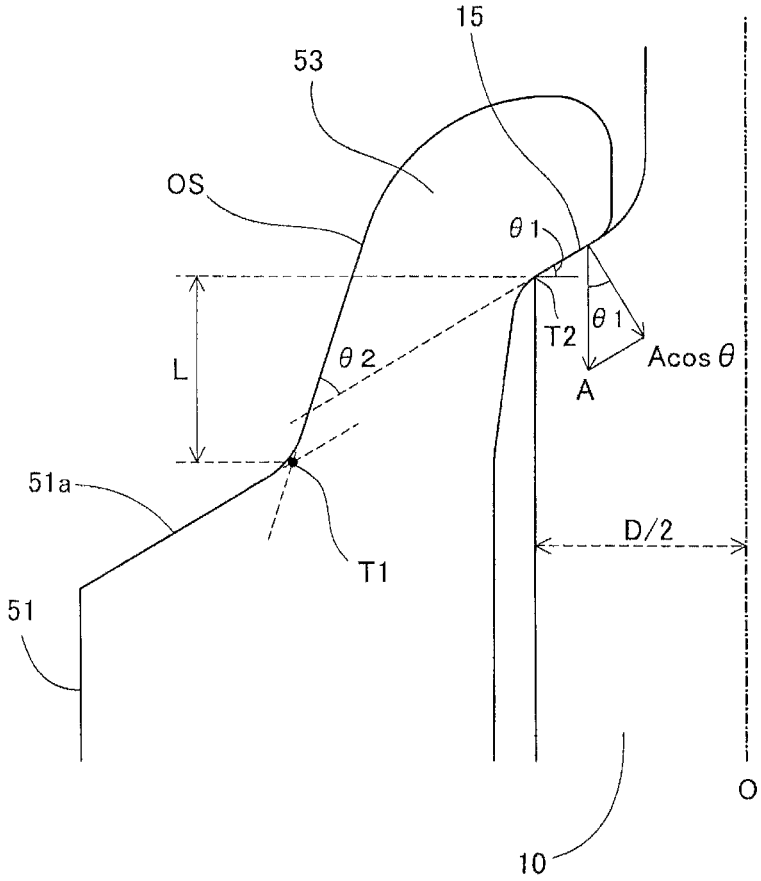
FIG. 3 is an enlarged view of a contact portion between an inner surface of a crimp portion and a rear end stepped portion of a ceramic insulator.
Figure 4:
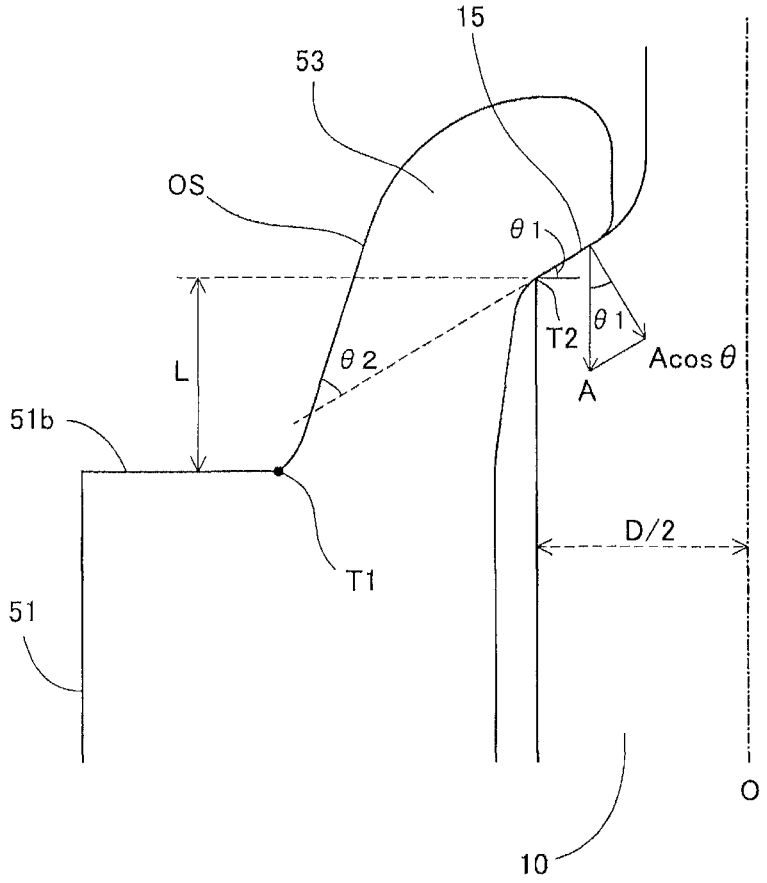
FIG. 4 is an enlarged view of a contact portion between an inner surface of a crimp portion and a rear end stepped portion of a ceramic insulator.

FIGS. 2 and 3 are enlarged views of a contact portion between the inner surface of the crimp portion 53 and the rear end stepped portion 15 of the ceramic insulator 10. As shown in FIG. 2, in this embodiment, in order to maintain a favorable contact between the inner surface of the crimp portion 53 and the rear end stepped portion 15 of the ceramic insulator 10 and to improve the airtightness therebetween, an area S (hereinafter referred to as a "projection area S") determined by an outer edge OE of the rear end stepped portion 15 and an inner edge IE of the crimp portion 53 falls within a range of 5 $mm^2$ to 25 $mm^2$, when the inner surface of the crimp portion 53 and the rear end stepped portion of the ceramic insulator 10 are projected on a plane perpendicular to the axial line O. Further, as shown in FIG. 3, in this embodiment, a narrow angle (hereinafter referred to as a "shoulder angle θ1") formed by a tapered surface of the rear end stepped portion 15 and a plane perpendicular to the axial line O falls within a range of 20 degrees to 60 degrees. Furthermore, in this embodiment, a distance L along the axial line O from a front end T1 of the proximal end portion of the crimp portion 53 to a frontmost position T2 of the contact portion between the inner surface of the crimp portion 53 and the rear end stepped portion 15 falls within a range of 0.4 mm to 1.8 mm. In addition, the shoulder angle θ1 is preferably 20 degrees to 50 degrees, and the distance L is preferably 0.8 mm or more to 1.2 mm or less. In addition, "the front end T1 of the proximal portion of the crimp portion 53" in the distance L is a point of intersection of an imaginary extended line of a slope surface 51*a* at the rear end side in the tool engagement portion 51 and an imaginary extended line of an outer surface OS of the crimp portion 53. As shown in FIG. 4, when the rear end side of the tool engagement portion 51 has no slope surface 51*a* but a horizontal surface 51*b*, the "front end T1 of the crimp portion 53" is defined as a point of intersection of the horizontal surface 51*b* and the outer surface OS of the crimp portion 53.

In this embodiment, as shown in FIG. 3, when the tapered surface of the rear end stepped portion 15 is extended in an outer circumference direction, the narrow angle (hereinafter referred to as a "cover angle θ2") defined by the tapered surface of the rear end stepped portion 15 and the outer surface OS of the crimp portion 53 preferably falls within a range of 15 degrees to 50 degrees. Further, a diameter of the outermost circumference portion of the rear end stepped portion 15 (hereinafter referred to as a "ceramic insulator diameter D") preferably falls within a range of 7 mm to 10 mm.

Each conditions described in the above embodiment will be summarized.

Condition 1: The projection area S is 5 $mm^2$ or more to 25 $mm^2$ or less.

Condition 2: The shoulder angle θ1 is 20 degrees or more to 60 degrees or less.

Condition 3: The distance L is 0.4 mm or more to 1.8 mm or less.

Condition 4: The cover angle θ2 is 15 degrees or more to 50 degrees or less.

Condition 5: The ceramic insulator diameter D is 7 mm or more to 10 mm or less.

Hereafter, the basis of the above conditions will be described with reference to the results of various evaluations.

B. Various Evaluations:

(B1) Conditions 1 to 3

Regarding the conditions 1 and 2, in order to evaluate the projection area S shown in FIG. 2 and the shoulder angle θ1 shown in FIG. 3, a plurality of spark plugs which differ in the projection area S and the shoulder angle θ1 was prepared. An airtightness test was conducted based on "JIS B 8031 Section 7.5". The result of the test is shown in Table 1. In this airtightness test, the spark plugs were kept at 150 degrees C. for 30 minutes, and thereafter, an air pressure of 1.5 MPa was applied to the vicinity of a spark gap of each spark plug so as to observe whether or not any air leakage from inside of the spark plug to the outside through the crimp portion 53 occurred.

TABLE 1

| | Shoulder Angle θ1 (°) | | | | | | | |
|---|---|---|---|---|---|---|---|---|
| Projection Area S | 10 | 20 | 30 | 40 | 50 | 60 | 70 | 80 |
| 3 $mm^2$ | X | X | X | X | X | X | X | X |
| 5 $mm^2$ | ○ | ○ | ○ | ○ | ○ | ○ | X | X |
| 10 $mm^2$ | ○ | ○ | ○ | ○ | ○ | ○ | X | X |
| 15 $mm^2$ | ○ | ○ | ○ | ○ | ○ | ○ | X | X |
| 20 $mm^2$ | ○ | ○ | ○ | ○ | ○ | ○ | X | X |
| 25 $mm^2$ | ○ | ○ | ○ | ○ | ○ | ○ | X | X |
| 30 $mm^2$ | ○ | ○ | ○ | ○ | ○ | ○ | ○ | ○ |

As shown in Table 1, the spark plugs having the projection area S of 3, 5, 10, 15, 20, 25 and 30 $mm^2$ and the shoulder angle θ1 varying between 10 and 80 degrees in steps of 10 degrees were prepared and tested. A spark plug which showed the air leakage through the crimp portion 53 was indicated with "x", and a spark plug which showed no air leakage was indicated with "○".

As shown in Table 1, the spark plugs having the projection area S of 3 $mm^2$ showed the air leakage at every shoulder angle θ1. On the other hand, the spark plugs having the projection area S of 30 $mm^2$ showed no air leakage. That is, when the projection area S is kept at 30 $mm^2$, it is possible to prevent the air leakage regardless of the shoulder angle θ1. Further, although the spark plugs having the projection area S between 5 and 25 $mm^2$ showed no air leakage at the shoulder angle θ1 of between 10 and 60 degrees, the air leakage was observed at the shoulder angle θ1 of between 70 and 80 degrees.

Thus, it was confirmed that the spark plugs having the projection area S ranging from 5 $mm^2$ to 25 $mm^2$ and the shoulder angle θ1 ranging from 10 degrees to 60 degrees were effective against the air leakage.

Next, in order to evaluate whether or not any crack was visually observed in the crimp portion 53, the spark plugs having the projection area S of either 5 $mm^2$ or 25 $mm^2$ as in Table 1 and varying in the shoulder angle θ1 between 0 to 40 degrees in steps of 5 degrees were prepared. The results are shown in Table 2.

TABLE 2

| | Shoulder Angle θ1 | | | | | | | | |
|---|---|---|---|---|---|---|---|---|---|
| Projection Area S | 0 | 5 | 10 | 15 | 20 | 25 | 30 | 35 | 40 |
| 5 $mm^2$ | X | X | X | X | ○ | ○ | ○ | ○ | ○ |
| 25 $mm^2$ | X | X | X | X | ○ | ○ | ○ | ○ | ○ |

As shown in Table 2, both the spark plugs having the projection area S of 5 $mm^2$ and the spark plugs having the projection area S of 25 $mm^2$ showed cracks in each crimp portion 53 at the shoulder angle θ1 of 15 degrees or less. However, no crack was observed in the spark plugs having the shoulder angle θ1 of 20 degrees or more. In view of the crack in the crimp portion 53, the shoulder angle θ1 is preferably 20 degrees or more as in the condition 2. A spark plug which showed the air leakage through the crimp portion 53 was indicated with "x", and a spark plug which showed no air leakage was indicated with "○".

In addition, as the shoulder angle θ1 becomes smaller, a load A cos θ that the crimp portion 53 presses the rear end stepped portion 15 corresponding to a crimping load A during the manufacturing process becomes greater (see FIG. 3). Thus, the ceramic insulator 10 can be held by a stronger force, and the airtightness can be improved as the shoulder angle θ1 is smaller. However, when the shoulder angle θ1 is substantially small, the crimp portion 53 is drastically bent during the manufacturing process, which tends to cause cracks in the crimp portion 53. Thus, the spark plug is likely to be fragile even though the airtightness is secured. Therefore, the shoulder angle θ1 of the condition 2 is defined as 20 degrees or more to 60 degrees or less based on the test results of Tables 1 and 2 so that both airtightness and strength of the spark plug may be secured.

Next, in order to evaluate the distance L of the condition 3, the spark plugs having the projection area S of either 5 $mm^2$ or 25 $mm^2$ as in Table 1 and varying in the distance L (see FIG. 3) between 0 mm to 0.8 mm in steps of 0.1 mm were prepared. Then, the thus-prepared spark plugs were visually observed to see whether or not any crack occurred in the crimp portion 53. The results are shown in Table 3.

TABLE 3

| | Distance L | | | | | | | | |
|---|---|---|---|---|---|---|---|---|---|
| Projection Area S | 0 | 0.1 | 0.2 | 0.3 | 0.4 | 0.5 | 0.6 | 0.7 | 0.8 |
| 5 $mm^2$ | X | X | X | X | ○ | ○ | ○ | ○ | ○ |
| 25 $mm^2$ | X | X | X | X | ○ | ○ | ○ | ○ | ○ |

As shown in Table 3, both the spark plugs having the projection area S of 5 $mm^2$ and the spark plugs having the projection area S of 25 $mm^2$ showed cracks in the crimp portion 53 when the distance L was 0.3 mm or less. However, no crack was observed in the spark plugs having the distance L of 0.4 mm or more. When the distance L is too short, the crimp portion 53 is drastically bent during the manufacturing process, which tends to cause a crack in the crimp portion 53. In view of the crack in the crimp portion 53, the distance L of the condition 3 is preferably 0.4 mm or more. A spark plug which showed the air leakage through the crimp portion 53 was indicated with "x", and a spark plug which showed no air leakage was indicated with "○".

In the case where the distance L is too long, a moment applied to the crimp portion 53 increases when a force pushing up the ceramic insulator 10 from the spark gap side is applied. As a result, the durability of the crimp portion 53 deteriorates. In order to evaluate the upper limit of the distance L, the spark plugs varying in the distance L between 0.4 mm and 2.4 mm in steps of 0.2 mm and in the shoulder angle θ1 between 20 degrees and degrees in steps of 10 degrees were prepared for the airtightness test. The results are shown in FIG. 5.

FIG. 5(A) is a graph showing a relationship between the distance L, the shoulder angle θ1 and an amount of air leakage when the projection area S is 5 $mm^2$. FIG. 5(B) is a graph showing a relationship between the distance L, the shoulder angle θ1 and an amount of air leakage when the projection area S is 25 $mm^2$. According to the graphs, in the projection area S of both 5 $mm^2$ and 25 $mm^2$, the spark plugs having the shoulder angle θ1 of between 20 degrees and 60 degrees and the distance L of between 0.4 mm and 1.8 mm showed that the amount of air leakage thereof was in the extent that would not interfere with an operation of an internal combustion engine (10 ml/min). This test result was consistent in the results of Tables 1 to 3, and the upper limit of the distance L in the condition 3 was determined to be 1.8 mm. In addition, when the shoulder angle θ1 ranges from 20 degrees to 50 degrees and the distance L ranges from 0.8 mm to 1.2 mm, the amount of air leakage was zero in the projection area S of both 5 $mm^2$ and 25 $mm^2$. That is, in the embodiment, it can be said that the shoulder angle θ1 preferably ranges from 20 degrees to 50 degrees, and the distance L preferably ranges from 0.8 mm to 1.2 mm.

(B2) Condition 4

Figure 6:
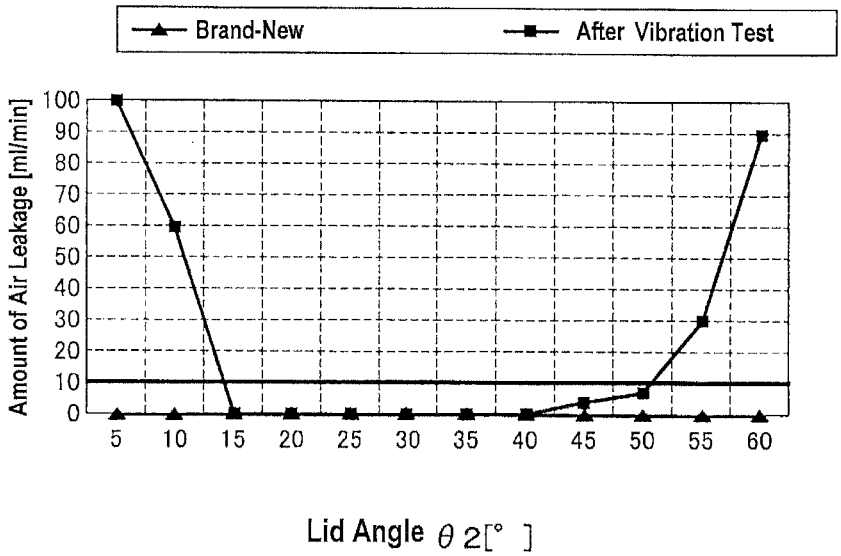
FIG. 6 is a graph showing a relationship between a cover angle θ2 and the amount of air leakage.

In the condition 4, the cover angle θ2 (refer to FIG. 3) is defined to be 15 degrees or more to 50 degrees or less. In order to evaluate the cover angle θ2, the spark plugs fulfilling the conditions 1 to 3 (i.e., the projection area S of 15 $mm^2$, the shoulder angle θ1 of 40 degrees and the distance L of 1.2 mm) were prepared. The thus-prepared spark plugs varied in the cover angle θ2 between 5 degrees and 60 degrees in steps of 5 degrees. Then, the amount of air leakage in brand-new spark plugs and the amount of air leakage in spark plugs after being subjected to a high temperature vibration test based on "ISO 11565 3.4.4" were measured. The results are shown in FIG. 6. The high temperature vibration test was conducted under the following conditions: the spark plug was subjected to vibration with a frequency band of 50-500 Hz, a sweep speed of 1 octave/min and an acceleration of 30 G for 8 hours in the axial direction and for 8 hours in a direction perpendicular to the axial direction while being heated (at about 200 degrees C.).

FIG. 6 is a graph showing a relationship between the cover angle and the amount of air leakage. As shown in FIG. 6, the brand-new spark plugs with the cover angle θ2 ranging from 5 degrees to 60 degrees showed zero air leakage. However, the spark plugs after the high temperature vibration test which had the cover angle θ2 of less than 15 degrees and of 50 degrees or more exhibited substantial increase in the amount of air leakage. Thus, considering the leakage amount which does not interfere with the operation of the internal combustion engine (10 ml/min), the cover angle θ2 is preferably 15 degrees or more to 50 degrees or less. With such cover angle θ2, it is possible to prevent a problem that loosening proof properties of the crimp portion 53 with respect to the rear end stepped portion 15 deteriorates due to substantially small cover angle θ2 and also prevent a problem that the crimp portion 53 cannot properly push down the ceramic insulator 10 due to an excessively large cover angle θ2, which causes deterioration in loosening proof properties.

(B3) Condition 5

Figure 7:
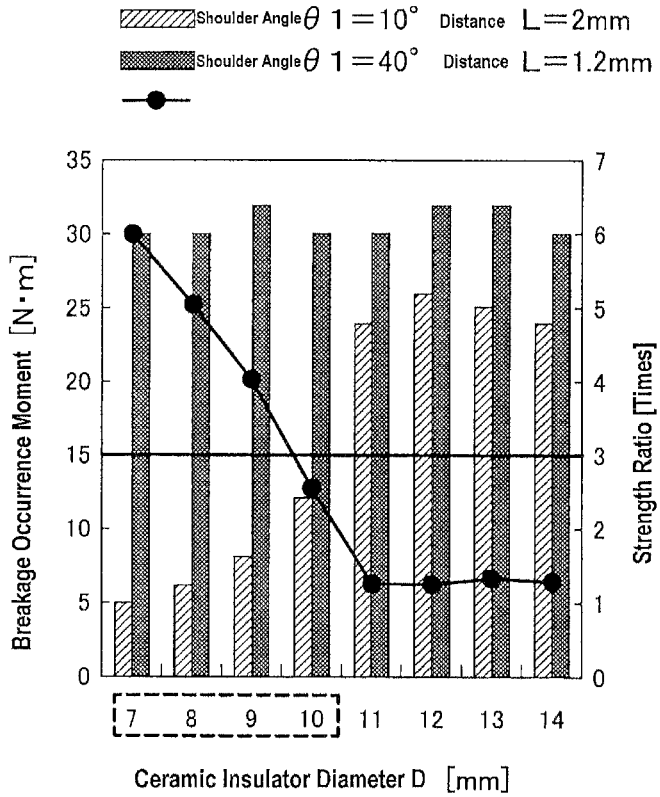
FIG. 7 is a graph showing a relationship between a diameter D of the ceramic insulator and a breakage occurrence moment.

In the condition 5, the diameter D of the ceramic insulator (see FIGS. 2 and 3) is determined to be 7 mm or more to 10 mm or less. In order to evaluate the diameter D of the ceramic insulator, the spark plugs which does not fulfill any one of conditions 1 to 3 (i.e., the projection area S of 15 $mm^2$, the shoulder angle θ1 of 10 degrees and the distance L of 2 mm), and the spark plug which fulfills the conditions 1 to 3 (i.e., the projection area S of 15 $mm^2$, the shoulder angle θ1 of 40 degrees and the distance L of 1.2 mm) were prepared. The ceramic insulators of the prepared spark plugs vary in the diameter D between 7 mm and 14 mm in steps of 1 mm. The thus-prepared ceramic insulators were subjected to an insulator strength test based on the "JIS B 8031_7.8" for measuring a moment when the ceramic insulator was broken. The result is shown in FIG. 7. In addition, the insulator strength test was conducted to check visually whether or not any crack occurs in the ceramic insulator. The insulator strength test was conducted such that a spark plug was mounted on an iron test jig with the maximum standard torque, and a normal load was gradually added to a location within 5 mm with respect to the front end of the ceramic insulator so that the product of a moment arm and the load added to the spark plug was 15 N·m. In this test, the load was applied to the spark plug at 10 mm/min or less so as not to make an impact on the spark plug.

FIG. 7 is a graph showing a relationship between the diameter D of the ceramic insulator and a breakage occurrence moment. As shown in FIG. 7, the spark plugs which did not fulfill the conditions 1-3 and had the diameter D of 10 mm or less exhibited extremely low values of the breakage occurrence moment, which was far below the normal value (15 N·m). On the other hand, the spark plugs which fulfilled the conditions 1 to 3 did not exhibit any significant difference in breakage occurrence moment when the diameter D of the ceramic insulator was between 7 mm and 14 mm. Each value of the breakage occurrence moment of those spark plugs was more than the standard value. In the ceramic insulator diameter D of 10 mm, the strength ratio of the spark plugs fulfilling the conditions 1-3 to the spark plugs not fulfilling the conditions 1-3 was about 2.5 times. In the ceramic insulator diameter D of 7 mm, the ratio of the same was 6 times. That is, as long as the spark plug fulfills the conditions 1 to 3, the sufficient strength can be secured even though the spark plug has the relatively small ceramic insulator diameter D between 7 mm and 10 mm.

According to the results of the tests, the spark plug 100 of the embodiments can secure the strength, airtightness and durability of the contact area of the rear end stepped portion 15 and the crimp portion 53 by fulfilling the conditions 1-3. Furthermore, as in the condition 5, even though the ceramic insulator diameter D is small, the sufficient strength is securable as long as the conditions 1-3 are fulfilled. Furthermore, when the condition 4 is fulfilled, the spark plug having suitable loosening proof properties is achievable.

As mentioned above, although the embodiment of this invention was described, this invention is not limited to such an embodiment, but can take various compositions in the area which does not deviate from the point.

Figure 8:
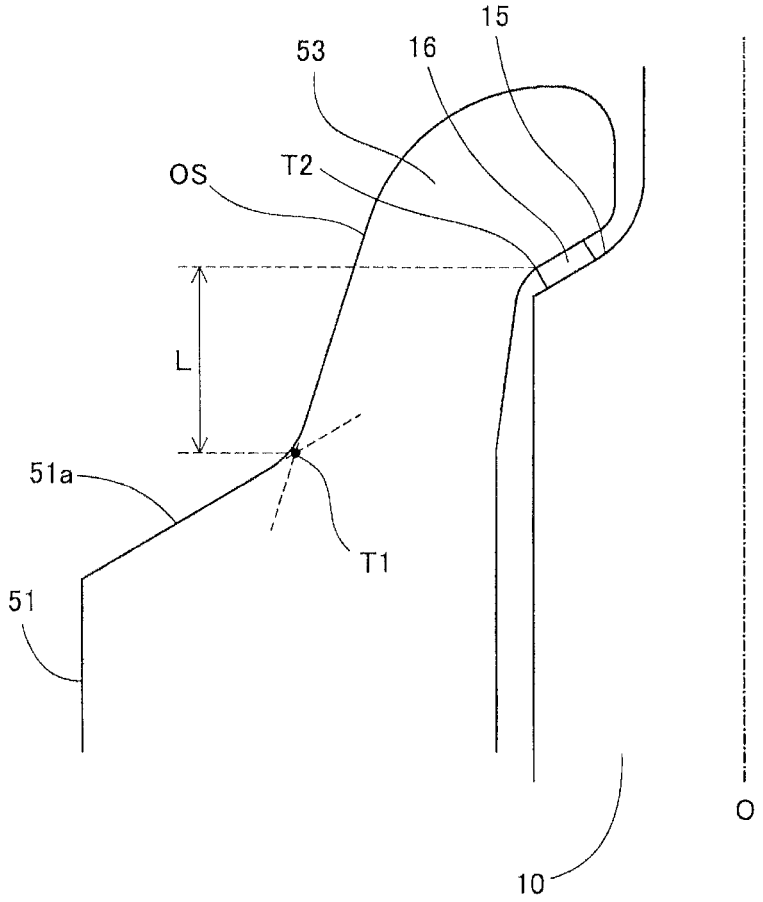
FIG. 8 shows that a packing is inserted between the inner surface of the crimp portion and the rear end stepped portion.

As shown in FIG. 8, since a sheet-like packing 16 maybe inserted between the inner surface of the crimp portion 53 and the rear end stepped portion 15, the airtightness therebetween can be improved. The packing 16 may be an iron packing that is preferably plated with nickel plating, zinc plating or the like. This plating contributes to an increase in coefficient of friction between the crimp portions 53 and the packing 16. When the packing 16 is inserted between the inner surface of the crimp portion 53 and the rear end stepped portion 15, the position T2 of the rear end of the distance L is determined to be the frontmost position of the contact portion between the inner surface of the crimp portion 53 and the packing 16.

| [Description of Reference Numerals] | |
|---|---|
| 3: | ceramic resistor |
| 4: | seal member |
| 5: | gasket |
| 8: | sheet packing |
| 10: | ceramic insulator |
| 12: | axial bore |
| 13: | insulator nose |
| 14: | front end stepped portion |
| 15: | rear end stepped portion |
| 16: | packing |
| 17: | front trunk portion |
| 18: | rear trunk portion |
| 19: | flange portion |
| 20: | center electrode |
| 21: | electrode base member |
| 25: | core |
| 30: | ground electrode |
| 31: | base member front end portion |
| 40: | metal terminal |
| 50: | metal shell |
| 51: | tool engagement portion |
| 52: | mounting threaded portion |
| 53: | crimp portion |
| 54: | seal portion |
| 55: | seat surface |
| 56: | step portion |
| 58: | contractive deformation portion |
| 59: | screw neck |
| 90: | electrode tip |
| 100: | spark plug |
| 200: | engine head |
| 201: | mounting threaded hole |
| 205: | peripheral surface around the opening |
| 501: | insertion hole |

The invention claimed is:

1. A spark plug comprising:

a cylindrical ceramic insulator including an axial bore extending along an axial line, a front end stepped portion whose diameter tapers from a rear end to a front end, and a tapered rear end stepped portion positioned rearward of the front end stepped portion and whose diameter tapers from the front end to the rear end;

a cylindrical metal shell including an engaging stepped portion that is provided on an inner circumferential surface thereof and is engaged with the front end stepped portion of the ceramic insulator from the rear end, and a crimp portion that is provided in a rear end portion of the metal shell and crimps the rear end stepped portion of the ceramic insulator from the rear end, wherein the front end stepped portion and the rear end stepped portion are provided on an outer circumferential surface of the ceramic insulator, the metal shell is fixed to the outer circumferential surface of the ceramic insulator, an area S defined by an outer edge of the rear end stepped portion and an inner edge of the crimp portion falls within a range of 5 $mm^2$ to 25 $mm^2$ when the spark plug is projected on a plane perpendicular to the axial line, an angle θ1 formed by a tapered surface of the rear end stepped portion and a plane perpendicular to the axial line falls within a range of 20 degrees to 60 degrees, and a distance L along the axial line from a front end of a proximal portion of the crimp portion to a frontmost position of a contact portion between an inner surface of the crimp portion and the rear end stepped portion falls within a range of 0.4 mm to 1.8 mm.

2. The spark plug according to claim 1, wherein the angle θ1 falls within a range of 20 degrees to 50 degrees, and the distance L falls within a range of 0.8 mm to 1.4 mm.

3. The spark plug according to claim 1, wherein, when the tapered surface of the rear end stepped portion is extended in an outer circumferential direction, an angle θ2, defined by the tapered surface and an outer surface of the crimp portion, falls within a range of 15 degrees to 50 degrees.

4. The spark plug according to claim 1, wherein a diameter D of an outermost circumferential portion of the rear end stepped portion falls within a range of 7 mm to 10 mm.

5. The spark plug according to claim 1, wherein the rear end stepped portion and the inner surface of the crimp portion are in contact with each other through a packing.

6. The spark plug according to claim 2, wherein, when the tapered surface of the rear end stepped portion is extended in an outer circumferential direction, an angle θ2 defined by the tapered surface and an outer surface of the crimp portion falls within a range of 15 degrees to 50 degrees.

7. The spark plug according to claim 2, wherein a diameter D of an outermost circumferential portion of the rear end stepped portion falls within a range of 7 mm to 10 mm.

8. The spark plug according to claim 3, wherein a diameter D of an outermost circumferential portion of the rear end stepped portion falls within a range of 7 mm to 10 mm.

9. The spark plug according to claim 2, wherein the rear end stepped portion and the inner surface of the crimp portion are in contact with each other through a packing.

10. The spark plug according to claim 3, wherein the rear end stepped portion and the inner surface of the crimp portion are in contact with each other through a packing.

11. The spark plug according to claim 4, wherein the rear end stepped portion and the inner surface of the crimp portion are in contact with each other through a packing.

* * * * *